United States Patent [19]

Kimoto et al.

[11] 4,421,624

[45] Dec. 20, 1983

[54] APPARATUS FOR CONTINUOUSLY PROCESSING A BAND-SHAPE MATERIAL

[75] Inventors: Yasuo Kimoto, Fujiidera; Masahiko Yamamoto, Nishinomiya; Katsunori Tamiya, Kobe; Yoshihito Sakai, Sakai; Akio Komura; Shoichi Honda, both of Osaka; Hidehiko Maehata, Suita; Hiroshi Kamada, Takatsuki; Tomohiko Suzaki, Ibaraki; Tomoya Inoue, Kawasaki, all of Japan

[73] Assignee: Hitachi Shipbuilding & Engineering Co., Ltd., Osaka, Japan

[21] Appl. No.: 244,619

[22] Filed: Mar. 17, 1981

[30] Foreign Application Priority Data

| | | | |
|---|---|---|---|
| Mar. 25, 1980 | [JP] | Japan | 55-38488 |
| Mar. 25, 1980 | [JP] | Japan | 55-38489 |
| Mar. 25, 1980 | [JP] | Japan | 55-38490 |
| Mar. 25, 1980 | [JP] | Japan | 55-38491 |
| Mar. 25, 1980 | [JP] | Japan | 55-38492 |
| Mar. 25, 1980 | [JP] | Japan | 55-39776[U] |
| Mar. 31, 1980 | [JP] | Japan | 55-42684 |

[51] Int. Cl.[3] ..... C25D 17/00; C25D 21/10

[52] U.S. Cl. ..... 204/209; 204/275; 204/277

[58] Field of Search ..... 204/209, 217, 275, 277, 204/278

[56] References Cited

U.S. PATENT DOCUMENTS

| | | | |
|---|---|---|---|
| 2,965,556 | 12/1960 | Damgaard | 204/217 |
| 3,102,090 | 8/1963 | Bassi | 204/217 |

*Primary Examiner*—T. M. Tufariello

*Attorney, Agent, or Firm*—Darby & Darby

[57] ABSTRACT

The present application discloses an equipment for continuously processing a band-shape material comprising transverse sliding shafts disposed on a base table, a basal board which freely slides transversely along said transverse sliding shafts, transverse-feeding means by which said basal board is quickly and/or slowly moved transversely, vertical sliding shafts disposed on said basal board, a tool of abrasion in combination with elctrolytic polishing which freely slides vertically along said vertical sliding shafts, vertical-feeding means by which said tool is moved vertically against said basal board and a polishing head which is disposed on said tool and composed of electrodes for electrolysis and abrasive matters for abrasion and by which continuously sent band-shape material is polished. In the case a band-shape material being conveyed is continuously polished for many hours, worn-out abrasive matters may be exchanged without interrupting the conveyance of said band-shape material, improving the working efficiency thereby.

10 Claims, 17 Drawing Figures

APPARATUS FOR CONTINUOUSLY PROCESSING A BAND-SHAPE MATERIAL

FIELD OF THE INVENTION

The present invention relates to an equipment for continuously processing a band-shape material, by which a band-shape material being conveyed is continuously processed for many hours by abrasion in combination with electrolytic polishing in which an electrolytic operation is combined with abrasion performed by an abrasive matter.

BACKGROUND OF THE INVENTION

Conventionally, in the process of abrasion in combination with electrolytic polishing in which an electrolytic operation is combined with abrasion performed by an abrasive matter, when a band-shape material is continuously conveyed and polished for many hours, abrasive matters wear out and the need for exchanging the abrasive matters arises. However, working efficiency is greatly reduced if the conveyance of a band-shape material is interrupted for the exchange of the abrasive matters.

DISCLOSURE OF THE INVENTION

The present invention provides an equipment for continuously processing a band-shape material comprising transverse sliding shafts disposed on a base table, a basal board which freely slides transversely along said transverse sliding shafts, transverse-feeding means by which said basal board is quickly and/or slowly moved transversely, vertical sliding shafts disposed on said basal board, a tool of abrasion in combination with electrolytic polishing which freely slides vertically along said vertical sliding shafts, vertical-feeding means by which said tool is moved vertically against said basal board and a polishing head which is disposed on said tool and composed of electrodes for electrolysis and abrasive matters for abrasion employed for continuously polishing the band-shape material being conveyed.

BRIEF DESCRIPTION OF THE DRAWINGS

The invention will further be described, by way of examples, with reference to the accompanying drawings, in which.

DETAILED DESCRIPTION OF PREFERRED EMBODIMENTS

Firstly, the description hereinafter will discuss the whole steps to which the equipment of the present invention is applied, with reference to the accompanying drawings of FIGS. 1 to 3, in which an example of the whole steps is shown.

Figure 1:
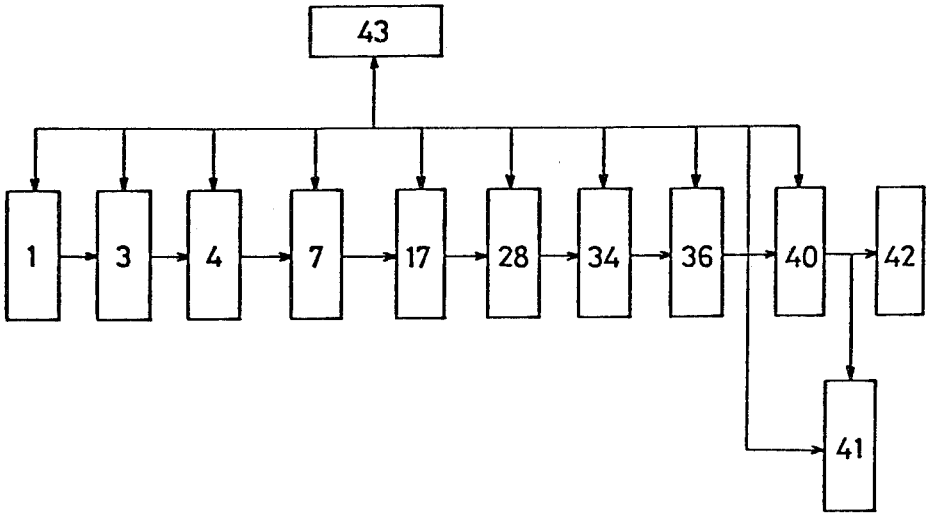
FIG. 1 is a block diagram showing the steps to which the present invention is applied.
Figure 3:
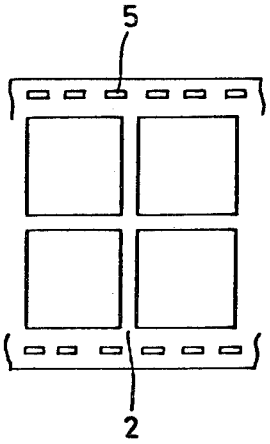
FIG. 3 is a plan view of a portion of a band-shaped material.
Figure 2:
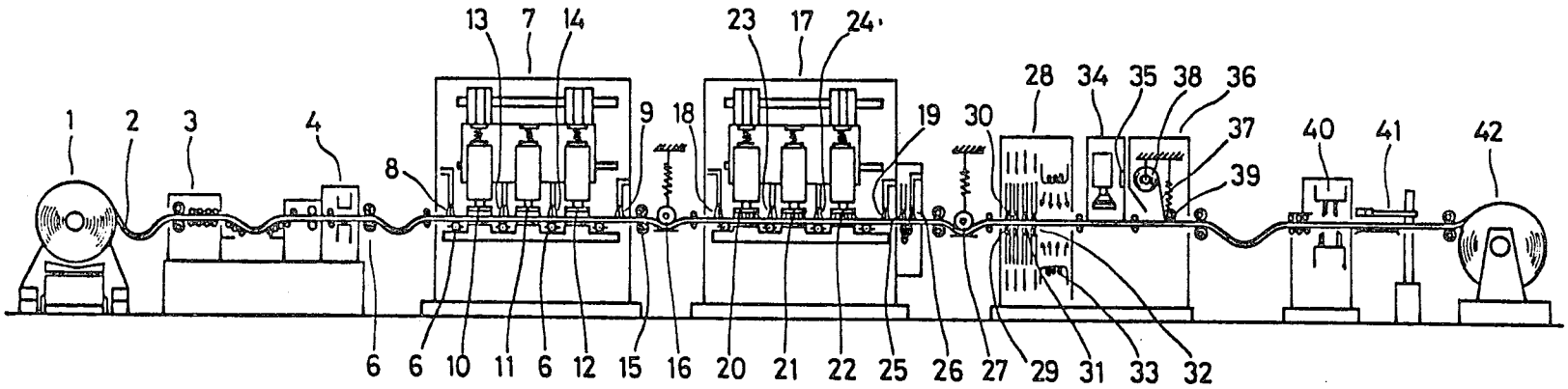
FIG. 2 is a schematic diagram of the respective steps in FIG. 1.

In FIGS. 1 to 3, a band-shape material 2 loaded to an uncoiler 1 is pulled out to a leveler 3 which adjust the band-shape material 2 so as to be flat, and is then conveyed to a perforating and pressing step 4. In this pressing step 4, holes 5 are formed in the band-shape material 2 at both edges thereof such that the band shape material 2 is thereafter conveyed at a predetermined speed by sprockets 6.

Then in a preliminary polishing step 7, the material 2 is semi-finished to remove surface defects by means of abrasion in combination with electrolytic polishing. Namely, air curtains 8 and 9 are disposed at the inlet and outlet of the preliminary polishing step 7, respectively. Disposed between these air curtains 8 and 9 are first, second and third tools of abrasion in combination with electrolytic polishing 10, 11 and 12. Shower curtains 13 and 14 are disposed between the tools 10 and 11, and between the tools 11 and 12, respectively.

These tools 10, 11 and 12 are so constructed that abrasive matters are radially formed on the surfaces of circular electrodes and electrolytes are supplied to the gaps between the material 2 and the abrasive matters from through-bores formed in the electrodes at the centers thereof, so that electrolytic polishing and abrasion made by the abrasive matters are performed with the tools rotated.

The grain sizes of the abrasive matters of the tools 10, 11 and 12 become gradually finer in the downstream direction. The tools 10, 11 and 12 are pressed to the band-shape material 2 at a predetermined force by springs.

The shower curtains 13 and 14 partition the electrolytes in the tools 10, 11 and 12 from each other, and the air curtains 8 and 9 prevent the electrolytes from flowing to the outside.

The band-shape material 2 is sent to a final polishing process 17 through a dehydrating roller 15 and an absorption roller 16 for absorbing the looseness of the band-shape material 2. In this final polishing process 17, the band-shape material 2 is mirror-finished.

Likely the previous step 7, this process 17 is provided with air curtains 18 and 19, first, second and third tools of abrasion in combination with electrolytic polishing 20, 21 and 22, and shower curtains 23 and 24.

The abrasive matters of the tools 20, 21 and 22 have grain sizes much finer than those of the abrasive matters in the previous step 7, and the grain sizes of the abrasive matters of the tools 20, 21 and 22 become gradually finer in the downstream direction.

After having passed through the final polishing step 17, the band-shape material 2 passes through a coarse-washing shower 25, an air curtain 26 and an absorption roller 27, and is sent to a washing and drying step 28.

In this washing and drying step 28, extraneous matter on the surface of the band-shape material 2 is washingly removed by showers 29, 30 and 31 disposed at the upper and lower sides of the band-shape material 2. Then, the band-shape material is dried by air curtains 32 and heater means 33.

The band-shape material 2 is then sent to a surface inspection step 34, where the band-shape material 2 is checked for surface roughness and defects, and if defective portions are detected, such portions are marked by marker means 35.

The band-shape material 2 is then sent to a surface protection step 36, where a protective film 37 is applied to the surface of the band-shape material 2. Namely, a protective film 37 made of a synthetic resin to which bonding material is applied and which is wound on a reel 38, is pulled out by a pressing roller 39, thereby to be applied, in lamination, to the band-shape material 2.

Then, in a press step 40, the band-shape material 2 is cut into a predetermined size as shown in FIG. 3, so that punched-out products are taken out by handling means 41, with residual material 2 wound on a winder 42.

It is to be noted that such steps are all controlled by a control device 43.

Although in the embodiment discussed hereinbefore, the feed of the band-shape material 2 is performed by the through-holes 5 and the sprockets 6, other suitable means such as pinch rolls or chain belts may also be used.

Figure 4:
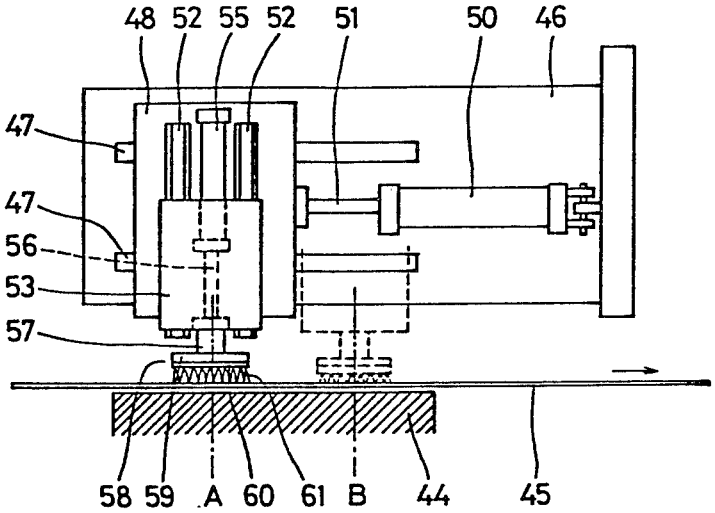
FIG. 4 is a front view of one embodiment of the present invention which relates to an equipment of continuously processing a band-shape material.
Figure 5:
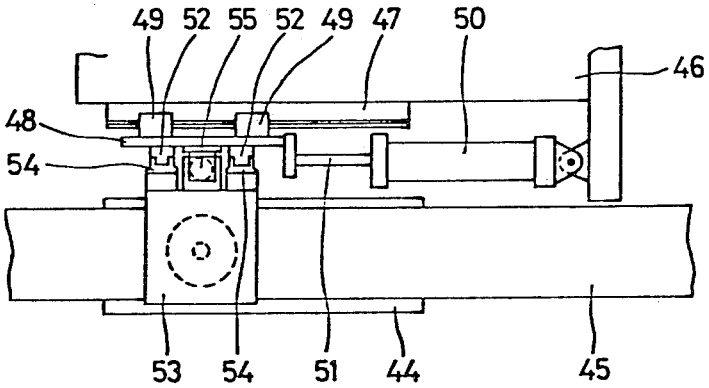
FIG. 5 is a plan view of FIG. 4.

Secondly, the description hereinafter will discuss the equipment of the present invention, with reference to the accompanying drawings of FIGS. 4 and 5, in which an embodiment of the present invention is shown and, of which FIG. 4 is a front view and FIG. 5 is a plan view.

Shown in FIGS. 4 and 5 are a polishing table 44, a band-shape material 45 which is conveyed for polishing from left to right on the polishing table 44 at a constant speed, a base table 46 disposed at the back of the polishing table 44, two transverse sliding shafts 47 formed transversely on the base table 46, a vertical basal board 48, and holders 49 formed on the backside of the basal board 48 in such a way that these holders 49 slidingly engage with the transverse sliding shafts 47, so that the basal board 48 may freely move transversely along the transverse sliding shafts 47.

A transverse liquid pressure cylinder 50 is supported by the base table 46, a piston rod 51 of the transverse cylinder 50 is connected with the right end of the basal board 48, constructing transverse-feeding means thereby by which the basal board 48 slides transversely along the transverse sliding shafts 47 accompanying the movement of the piston rod 51 by the operation of the transverse cylinder 50.

Two vertical sliding shafts 52 are formed vertically on the front surface of the basal board 48. A tool of abrasion in combination with electrolytic polishing 53 are also included and, holders 54 are formed on the backside of the tool 53 in such a way that these holders 54 slidingly engage with the vertical sliding shafts 52, so that the tool 53 may freely move vertically along the vertical sliding shafts 52.

The apparatus further comprises a vertical cylinder 55 supported by the basal board 48, a piston rod 56 of the vertical cylinder 55 connected with the tool 53, constructing vertical-feeding means thereby by which the tool 53 slides vertically along the vertical sliding shafts 52 accompanying the movement of the piston rod 56 by the operation of the vertical cylinder 55.

Additionally, a pivot 57 is extended downward from the tool 53 and rotated by the driving mechanism within the tool 53, and a polishing head 58 is fitted at the tip of the pivot 57 and composed of electrodes 60 radially formed on the lower surface of a disc 59 and abrasive matters 61 are affixed on the lower surface of both the disc 59 and the electrodes 60.

Abrasive matters 61 are brought in contact with the band-shape material 45 with a predetermined pressing force. Electrolyte which has passed through the central bore formed in the pivot 57 and the disc 59 is supplied from the tool 53 into the gaps between the electrodes 60 and the band-shape material 45. The polishing head 58 is rotated by the pivot 57, and electricity is supplied from the tool 53 to the electrodes 60 and from the polishing table 44 to the band-shape material 45. By above means, electrolytic polishing and abrasion performed by the abrasive matters 61 are combined for the polishing of the band-shape material 45.

According to the present invention, in a state where the band-shape material 45 is continuously conveyed from left to right and the polishing head 58 is performing abrasion in combination with electrolytic polishing on the first position A of FIG. 4, when the abrasive matters 61 wear out after use for many hours, the vertical cylinder 55 is operated to move the polishing head 58 together with the tool 53 in upward direction, the rotation of the polishing head 58 is stopped and then the worn-out abrasive matters 61 are exchanged with new abrasive matters 61. Thereafter the transverse cylinder 50 is operated to move the polishing head 58 together with the basal board 48 at a higher speed than the speed at which the band-shape material 45 is conveyed, until the polishing head 58 comes to the second position B of FIG. 4. Then the vertical cylinder 55 is operated to move the polishing head 58 in downward direction, so that polishing may be resumed on the second position B.

The distance between the first position A and the second position B hereupon may be equivalent to the distance of the band-shape material 45 being conveyed during the time required for exchanging abrasive matters 61 and upward, downward and transverse movement of the polishing head 58 plus some additional distance allowed for overlap.

Then, the transverse cylinder 50 is operated to move slowly the polishing head 58 from the second position B to the first position A within the life of the abrasive matters 61, and when the abrasive matters 61 wear out on the first position A, the polishing head 58 is again moved in upward direction so that the abrasive matters 61 may be exchanged.

Although in the discussion hereinbefore the exchange of abrasive matters 61 is performed on the first position A, the exchange may also be performed on the second position B.

As discussed hereinbefore, by means of the equipment of continuously processing the band-shape material in the present invention, worn-out abrasive matters may be exchanged without interrupting the conveyance of the band-shape material, thereby improving the working efficiency and excluding the need for preparing a spare polishing head for the exchange of the abrasive matters.

Now the description hereinafter will discuss in detail another embodiment of the equipment of the present invention with reference to the accompanying FIGS. 6 and 7.

Figure 6:
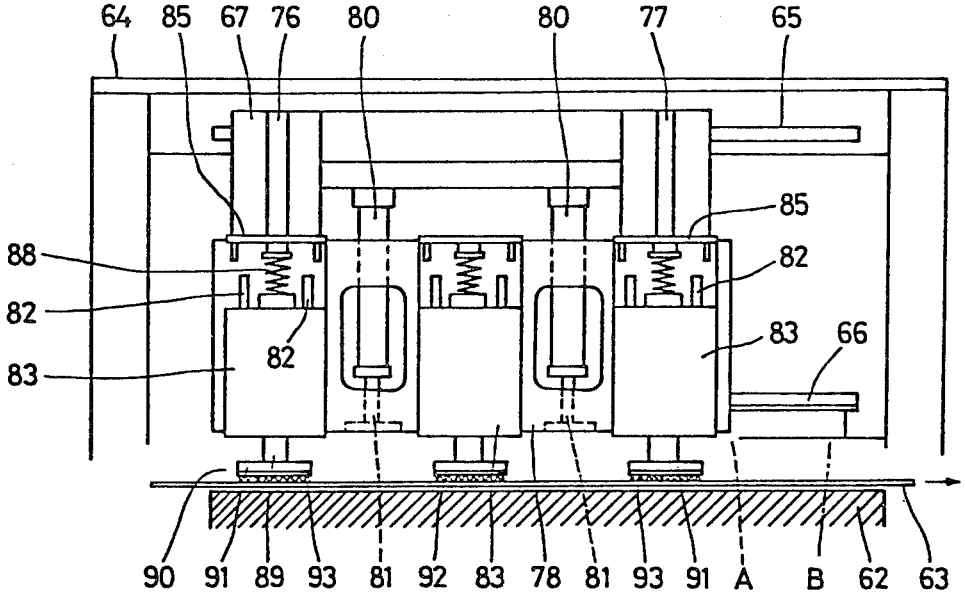
FIG. 6 is a front view of another embodiment of the present invention.
Figure 7:
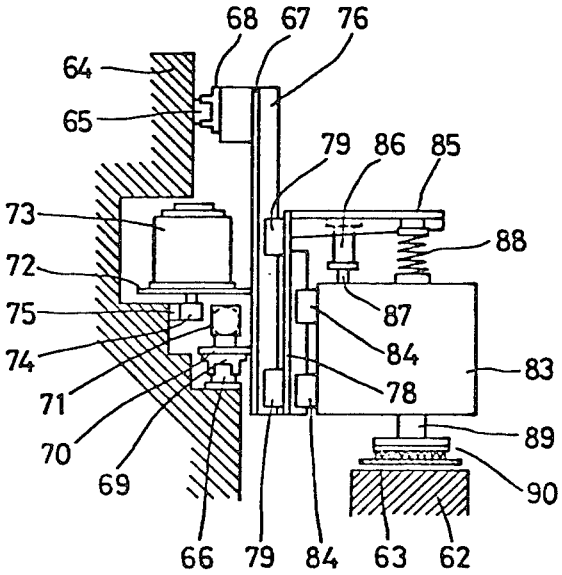
FIG. 7 is a side view of FIG. 6.

Shown in these FIGS. 6 and 7 are a polishing table 62, a band-shape material 63 which is conveyed for polishing from left to right on the polishing table 62 at a constant speed, a base table 64 disposed at the back of the polishing table 62, two transverse sliding shafts 65 and 66 disposed transversely on the upper and lower part of the base table 64, respectively, a vertical basal board 67, and holders 68 and 69 formed on the upper and lower part on the backside of the basal board 67, respectively, in such a way that these holders 68 and 69 slidingly engage with the transverse sliding shafts 65 and 66, respectively, so that the basal board 67 may move freely in transverse direction along the transverse sliding shafts 65 and 66.

A lower assistant board 70 is disposed on the lower part of the basal board 67, a quick-forward cylinder 71 is supported by the lower assistant board 70. The tip of the piston rod thereof is connected with the base table 64, so that the basal board 67 is transversely quick-forwarded by the operation of the quick-forward cylinder 71.

An upper assistant board 72 is disposed on the basal board 67 and positioned at higher level than the lower assistant board 70. A slow forward motor 73 is placed on the upper assistant board 72, a pinion 74 is equipped on the pivot of the motor 73, and a rack 75 is disposed on the base table 64, the pinion 74 being geared with the rack 75 and thereby the basal board 67 is slowly moved transversely by the driving of the motor 73.

Two vertical sliding shafts 76 and 77 are disposed vertically on both sides of the basal board 67. A vertical holding board 78, and holders 79 are formed vertically on the backside of the holding board 78 on the left and the right ends thereof, respectively, in such a way that these holders 79 slidingly engage with the vertical sliding shafts 76 and 77, so that the holding board 78 may move freely along the vertical sliding shafts 76 and 77.

Two vertical cylinders 80 are disposed having an upper part supported by the basal board 67 on the left and the right parts thereof. The piston rods 81 of the vertical cylinders 80, and the tip of such piston rod 81 is connected with the holding board 78, so that the holding board 78 may be moved vertically along the vertical sliding shafts 76 and 77 by the operation of the vertical cylinders 80.

A plurality of individual vertical sliding shafts 82 are included, two of such sliding shafts 82 being disposed on the front side of each holding board 78. A plurality of tools of abrasion in combination with electrolytic polishing 83 and, holders 84 are formed on the backside of the respective tools 83 in such a way that these holders 82 slidingly engage with the individual sliding shafts 82, so that each tool 83 may move freely along the respective sliding shafts 82.

A plurality of supporting boards 85 are disposed on the upper end of the holding board 78 and extended to the front. A plurality of individual cylinders 86 are supported by the respective supporting boards 85. Piston rods 87 are associated with individual cylinders 86, the lower tip of such piston rods 87 being connected with the respective tools 83, so that each tool 83 may move vertically along the respective individual sliding shafts 82 by the operation of the respective individual cylinders 86.

Springs 88 for regulating pressing force are disposed between each tool 83 and the respective supporting board 85, whereby the respective tools 83 are pressed downward and the pressing force may be freely regulated.

Pivots 89 are extended in a downward direction from the respective tools 83 and rotated by the driving mechanism within the tools 83. Polishing heads 90 are fitted at the tip of the pivots 89 and composed of electrodes 92 radially formed on the lower surface of discs 91 and abrasive matters 93 affixed on the lower surface of both the discs 91 and the electrodes 92, such abrasive matters 93 containing abrasive grains whose grain sizes become gradually finer in the right hand direction.

As shown in FIGS. 6 and 7, the respective abrasive matters 93 are brought in contact with the band-shape material 63 with predetermined pressing force. Electrolyte which has passed through the central bores formed in the pivot 89 and the disc 91 is supplied from the respective tools 83 into the gaps between electrodes 92 and the band-shape material 63. Each polishing head 90 is rotated by the respective pivots 89, and electricity is supplied from the tool 83 to the electrodes 92 and from the polishing table 62 to the band-shape material 63. By above means, electrolytic polishing and abrasion performed by the abrasive matters 93 are combined for the sequential polishing of the band-shape material 63.

Since any tools 83 may be moved optionally upward by means of operations of the respective individual cylinders 86, a plurality of tools 83 may be selectively used.

Furthermore in a state shown in FIG. 6, the holding board 78 is positioned on the first position A to perform abrasion in combination with electrolytic polishing. When individual abrasive matters 93 wear out after use for many hours, the vertical cylinders 80 are operated to move the respective tools 83 together with the holding boards 78 in an upward direction, the rotation of the polishing head 90 is stopped, and the worn-out abrasive matters 93 are exchanged with new abrasive matters 93. Thereafter the quick-forward cylinder 71 is operated to quick-forward the holding board 78 together with the basal board 67 and the respective tools 83 at a higher speed than the speed at which the band-shape material 63 is conveyed, until the holding board 78 comes to the second position B of FIG. 6. The vertical cylinders 80 are then operated to move the respective polishing heads 90 together with the holding board 78 in a downward direction, so that polishing may be resumed on the second position B.

As discussed hereinbefore, in the case of the above embodiment of the present invention, worn-out abrasive matters may be exchanged without interrupting the conveyance of the band-shape material and in addition the whole equipment becomes compact, the operational functions become intensive and each polishing head may be selectively used.

Now the description hereinafter will discuss in detail another embodiment of the present invention with reference to the accompanying FIG. 8.

Figure 8:
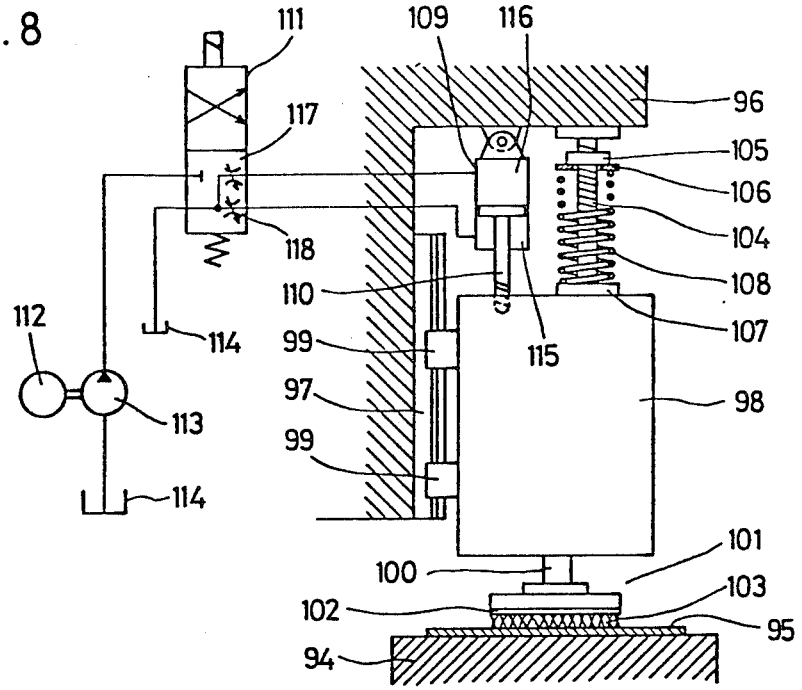
FIG. 8 is a side view of still another embodiment of the present invention.

Shown in FIG. 8 are a polishing table 94, a band-shape material 95 which is conveyed in forward and/or backward direction on the polishing table 94, a base table 96 positioned above the polishing table 94, a sliding body 97 composed of sliding shafts disposed vertically on the side of the base table 96, a tool of abrasion in combination with electrolytic polishing 98. A holder 99 composed of a bearing is disposed on the side of the tool 98 and slidingly engages with the sliding body 97 so that the tool 98 may move freely in vertical direction by means of the holder 99 and the sliding body 97.

A pivot 100 is extended downward from the tool 98 and rotated by the driving mechanism within the tool 98. A polishing head 101 is fitted at the tip of the pivot 100 and is composed of electrodes 102 radially formed on the disc and abrasive matters 103 affixed on the lower surface of the electrodes 102. Such abrasive matters 103 are brought in contact with the band-shape material 95, and electrolyte which has passed through the central bore formed in the pivot 100 and said disc is supplied into the gaps between the electrodes 102 and the band-shape material 95.

A screw shaft 104 is planted on the lower surface of the upper part of the base table 96 and extended in a downward direction. An adjust nut 105 engages with the screw shaft 104, and a holding plate 106 is disposed on the lower surface of the nut 105. A holding frame 107 is disposed on the upper surface of the tool 98, and a spring 108 is disposed between the holding frame 107 and the holding plate 106 and penetrated by the screw shaft 104, pressing the tool 98 downward thereby.

A liquid pressure cylinder 109 is supported by the lower surface of the base table 96. A piston rod 110 associated with the cylinder 109, has a tip connected with the upper end of the tool 98, and a switch valve 111.

When the switch valve 111 is operated by means of the pump 113 driven by the motor 112, the liquid contained in the tank 114 flows into the first chamber 115 of the cylinder 109 by way of the switch valve 111 and the liquid in the second chamber 116 of the cylinder 109 flows back to the tank 114 by way of the switch valve 111. In the discussion hereinbefore, the state of the valve 111 has to be switched from the state shown in FIG. 8. Therefore by the upward movement of the piston rod 110, the tool 98 is also moved upward accordingly.

When the switch valve 111 stops operation, like the state shown in FIG. 8, the first chamber 115 and the second chamber 116 are connected by way of flow regulating valves 117 and 118 disposed within the switch valve 111, and the tool 98 is moved downward due to the weight of the tool 98 itself and the pressing force of the spring 108. During the above process, by means of the flow regulating valves 117 and 118 the downward movement of the piston rod 110, namely the downward movement of the tool 98 gradually proceeds, until the downward movement is balanced with the pressing force of the spring 108 and the tool 98 comes to a standstill.

Therefore, according to the equipment described in the above embodiment of the present invention, in a state shown in FIG. 8 where the switch valve 111 is not operated, the polishing head 101 rotates and the electrolyte is supplied. Abrasion in combination with electrolytic polishing is performed thereby, and the pressing force of the polishing head 101, namely abrasive matters 103, against the band-shape material 95 is determined by the spring 108. While the pressing force must be regulated depending on the purpose of polishing and/or the abrasive matters 103 being used, such pressing force can be easily regulated by the upward and/or downward movement of the adjust nut 105.

In addition, when the surface of the band-shape material 95 is uneven, impact vibrations arise in the tool 98 if a spring 108 only is used. However, against the impact displacement of the tool 98, the flow regulating valves 117 and 118 may mitigate the sudden displacement of the piston rod 110 and damp the vibrations of the tool 98, this making uniform polishing of the surface possible.

The regulation of said damping force may be performed arbitrarily by changing the degree of opening of the flow regulating valves 117 and 118. The flow regulating valves may be disposed not within the switch valve 111 but in the external circuit of the switch valve 111.

In addition, when the switch valve 111 is operated and the pump 113 is driven, the tool 98 easily moves upward and the exchange of the abrasive head 101 may be easily performed.

Now the description hereinafter will discuss in detail another embodiment of the equipment of the present invention with reference to the accompanying FIG. 9.

Figure 9:
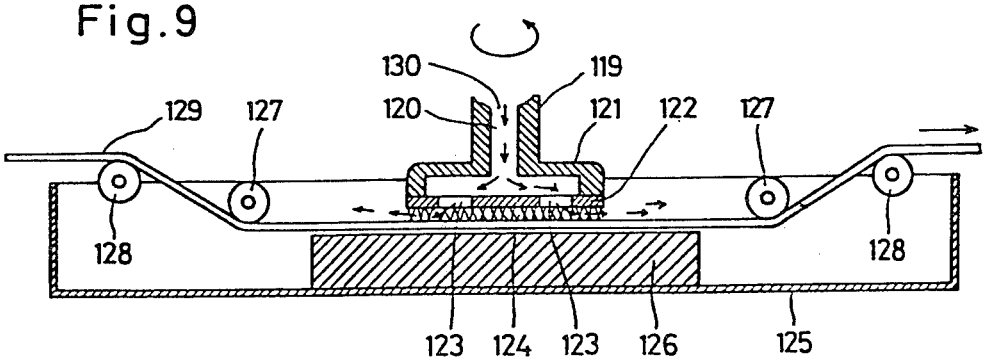
FIG. 9, FIG. 10 and FIG. 11 are respectively front section views of a portion of other embodiments of the present invention.

Shown in FIG. 9 are a pivot 119 which is extended downward from the tool and is rotated by the driving mechanism within the tool. A central bore 120 is formed in the pivot 119, and a supporting board 121 which is shaped like an upended dish is formed at the lower end of the pivot 119. Circular electrodes 122 are fitted on the supporting board 121 with radially formed electrode surfaces, and a plurality of through-bores 123 are perforated in the electrodes 122. Abrasive matters 124 affixed on the electrodes 122. A receptacle tank 125 are polishing table 126 are disposed within the receptacle tank 125. Two pressing rollers 127 are disposed on both sides of the polishing table 125, the lower end of said pressing rollers 127 being positioned at almost the same level as the upper end of the polishing table 125. Upward-pressing rollers 128 are disposed outside both pressing rollers 127, the upper end of said upward-pressing rollers 128 being positioned at a higher level than the lower end of the pressing rollers 127. A long band-shape material 129 is conveyed for polishing from left to right passing on the upper end of the left-hand upper-pressing roller 128, the lower end of the left-hand pressing roller 127, the surface of the polishing table 125, the lower end of the right-hand pressing roller 127 and the upper end of the right-hand upward-pressing roller 128.

The abrasive matters 124 are pressed against the band-shape material 129 on the polishing table 125, Electrolyte is supplied from the tool, through the central bore 120 of the pivot 119 and the through-bore 123 of the electrodes 122 into the gaps between the electrodes 122 and the band-shape material 129, and electricity is supplied to the electrodes 122 and the band-shape material 129 as the pivot 119 rotates. The band-shape material 129 is abraded in combination with electrolytic polishing thereby.

In the above process, since the polishing site of the band-shape material 129 is positioned low by means of both pressing rollers 127 and those part of band-shape material 129 on both sides of the polishing site are positioned high by means of upward-pressing rollers 128, the electrolyte submitted to electrolytic polishing will totally drop into the receptacle tank 125 without being transferred to the right in downstream direction, avoiding spilling thereby.

Therefore in the case of the above embodiment of the present invention, by positioning the polishing site of the band-shape material at the lower level than the level at which the band-shape material is conveyed elsewhere, the electrolyte is totally collected in the receptacle tank and the spilling of the electrolyte is prevented thereby.

Now the description hereinafter will discuss another embodiment of the equipment of the present invention with reference to the accompanying drawing of FIG. 10.

Figure 10:
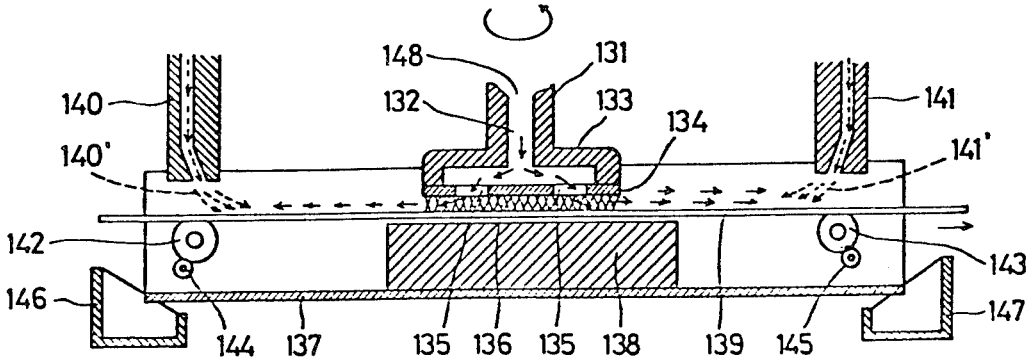

Shown in FIG. 10 is a pivot 131 which is extended downward from the tool and is rotated by the driving mechanism within the tool, a central bore 132 formed in the pivot 131, a supporting board 133 which is shaped like an upended dish and formed at the lower end of the pivot 131, circular electrodes 134 fitted on the supporting board 133 with radially formed electrode surface, a plurality of through-bores 135 perforated in the electrodes 134 and abrasive matters 136 affixed on the electrodes 134. A receptacle body 137 shaped like a tub, and a polishing table 138 is disposed within the receptacle body 137. A band-shape material 139 is sent for polishing from left to right on the polishing table 138. Jet nozzles of compressed air 140 and 141 are disposed over the band-shape material 139 on both sides of the electrodes 134, the nozzle holes of which are directed inward so that the respective jet air 140' and 141' are jetted towards the electrodes 134.

Absorption rollers 142 and 143 pressingly contact the lower surface of the band-shape material 139 right below the respective nozzles 140 and 141, the left-hand roller 142 rotating clockwise and the right-hand roller 143 rotating counterclockwise;

Wringing rollers 144 and 145 pressingly contact the absorption rollers 142 and 143, respectively. Receptacle boxes 146 and 147 are disposed on both sides of the receptacle body 137.

The abrasive matters 136 are pressed against the band-shape material 139 on the polishing table 138, the electrolyte 148 is supplied from the tool through the central bore 132 of the pivot 131 and through-bores 135 of the electrodes 134 into the gaps between the electrodes 134 and the band-shape material 139. Electricity is supplied to the electrodes 134 and the band-shape material 139 as the pivot 131 rotates, and the band-shape material 139 is abraded in combination with electrolytic polishing.

Hereat the electrolyte 148 which has flown out in outward direction from under the electrode 134 is apt to flow outward along the upper surface of the band-shape material 139, however, by the jetting force of the air from both nozzles 140 and 141, outside leakage of the electrolyte 148 is prevented.

The electrolyte dropped from the side edge of the band-shape material 139 is received by the receptacle body 137 and the electrolyte leaking into the lower surface of the band-shape material 139 from the side edge of the band-shape material 139 is absorbed by the absorption rollers 142 and 143, and by means of wringing rollers 144 and 145, received in the receptacle boxes 146 and 147.

Therefore, in the case of above embodiment, the outside efflux of the electrolyte on the polishing surface is avoided without contacting the absorption roller with the upper surface of the band-shape material, thereby preventing scratches and other defects, and high-quality polishing surface is obtained. Since the band-shape material is polished without being bent, no warp or deflection will arise.

The description hereinafter will discuss another embodiment of the present invention with reference to the accompanying FIGS. 11 to 15. In these embodiments, when a long band-shape material being conveyed is abraded in combination with electrolytic polishing using at least two tools, the grains of a large size in the preceding process are prevented from mixing with the electrolyte of the subsequent process.

Figure 11:
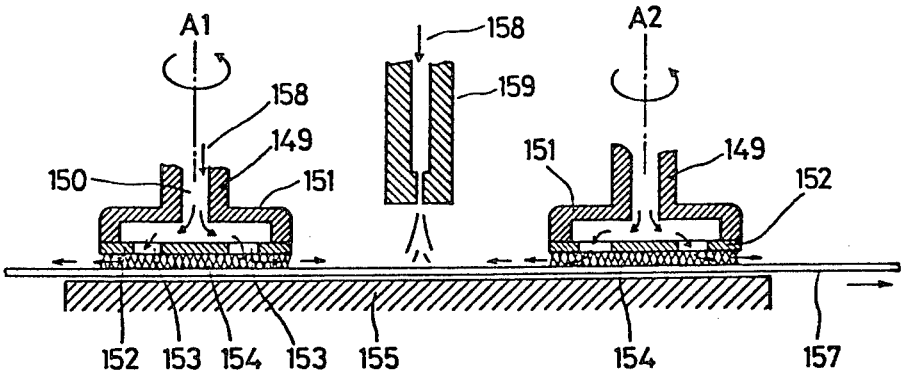
Figure 12:
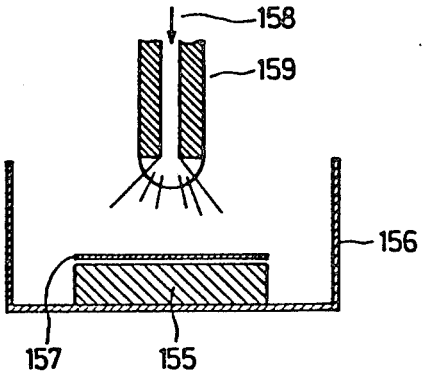
FIG. 12 is a side section view of FIG. 11.

Firstly, shown in FIGS. 11 and 12 which describe an example, are a pivot 149 which is extended downward from the first tool A1 and is rotated by the driving mechanism within the tool. A central bore 150 is included in pivot 149. A fitting mount 151 is shaped like an upended dish and formed at the lower tip of the pivot 119. A circular electrode 152 is fitted on the fitting mount 151 with a radially formed electrode surface. A plurality of through-bores 153 are perforated in the electrode 152. Abrasive matters 154 are affixed on the electrode 152 and abrasive grains are attached thereto. A polishing table 155 is disposed in the receptacle tank, and a long band-shape material 157 is conveyed for polishing from left to right on the polishing table 155.

Abrasive matters 154 are pressed against the band-shape material 157 on the polishing table 155. Electrolyte 158 is supplied from the tool A1 through the central bore 150 of the pivot 149 and the through-bores 153 of the electrode 152 into the gaps between the electrode 152 and the band-shape material 157. Electricity is supplied to the electrode 152 and the band-shape material 157 as the pivot 149 rotates, thereby the band-shape material 157 is abraded in combination with electrolytic polishing.

The second tool A2 is constructed in a similar way to the first tool A1. The abrasive grains attached to the abrasive matters 154 of the first tool A1 are small-numbered and of a large size while the abrasive grains attached to the abrasive matters 154 of the second tool are large-numbered and of a small size. The first tool A1 is disposed on the left and the second tool A2 is disposed on the right.

A jet nozzle 159 is disposed between both tool A1 and A2, and as shown in FIG. 12, the electrolyte 158 is jetted in a fan-shaped manner across the band-shape material 157, whereby a partition is formed between the electrolyte 158 from the tool A1 and the electrolyte 158 from the tool A2, and the electrolytes from the respective tools A1 and A2 are intercepted from each other, thereby preventing the intermixture thereof, by means of jet pressure of the jetted electrolyte, and the intermixture of fallen-off grains in the electrolyte.

Therefore the grains of a large size in the electrolyte from the first tool A1 will not transfer to the side of the second tool A2, and the occurrence of scratches is prevented. In addition, since the jet pressure of the electrolyte from the nozzle 159 is employed, the band-shape material 157 is free from the direct contact with the nozzle 159 and the polishing surface of the band-shape material 157 is not damaged.

Besides the electrolyte, air and other gases may be used as the liquid jetted from the jet nozzle 159, and the electrolyte 158 flown into the receptacle tank 156 is filtered, thereby removing the abrasive grains, and may be re-used.

Figure 14:
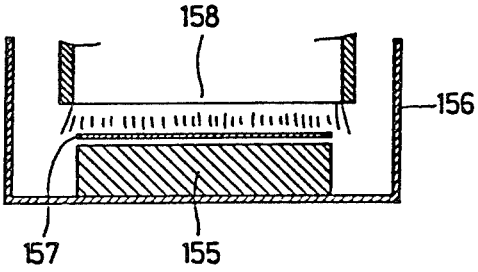
FIG. 14 is a side section view of FIG. 13.
Figure 13:
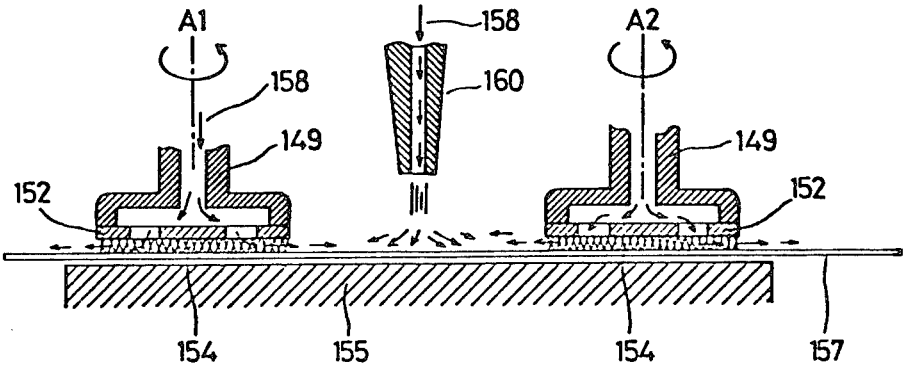
FIG. 13 is a front section view of a portion of another embodiment of the present invention.

Refer now to FIGS. 13 and 14 which show another example. In this example, what differs from the example shown in FIGS. 11 and 12 is the structure of the jet nozzle 160, wherein the outlet of the nozzle is formed as a slit and the form of jetted liquid is rectangular.

Figure 15:
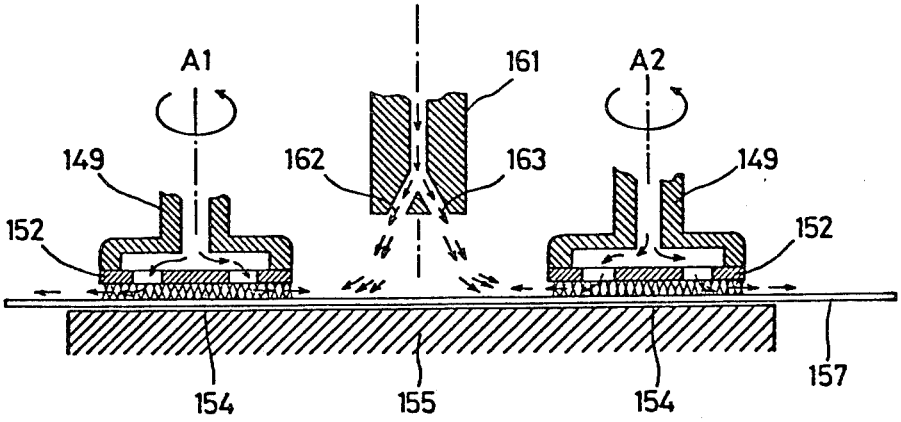
FIG. 15 is a front section view of a portion of another embodiment of the present invention.

Next, the discussion is made with reference to FIG. 15 which shows still another example. In this example, what differs from FIGS. 11 and 12 is also the structure of the jet nozzle 161, wherein the jetting outlet diverges forming two outlets and each of the outlets 162 and 163 faces outward, namely in the directions of the first tool A1 and the second tool A2, respectively.

Hereat intermixture of electrolyte from both tools A1 and A2 is more strictly prevented even if the nozzle 161 is disposed not necessarily in vertical direction but slanted a little, intermixture of electrolyte 158 is prevented.

Therefore according to the example shown in FIGS. 11 to 15, in the case that two tools are disposed side by side for polishing, the electrolyte flown out from both tools will not intermix. The abrasive grains of a large size in the preceding process will not mix into the subsequent process, and the occurrence of scratches is prevented.

Next, the description hereinafter will discuss another embodiment of the present invention with reference to the accompanying FIG. 16. In this embodiment, the electrolytes from the two tools disposed side by side will not intermix with each other, the fallen-off grains in the preceding process is prevented from entering the subsequent process, and the bias of the band-shape material is also prevented.

Figure 16:
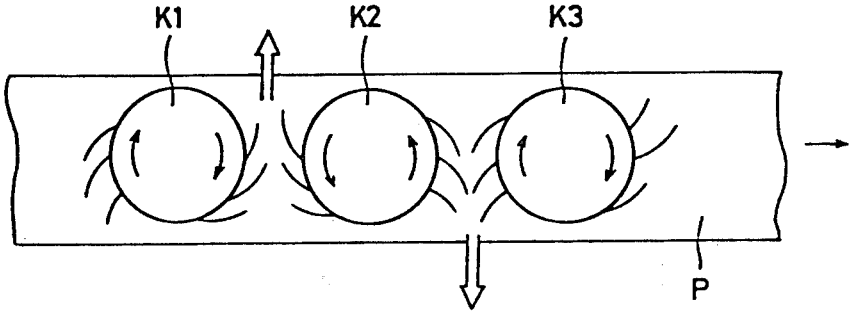
FIG. 16 is a plan view of a portion of another embodiment of the present invention.

Namely as shown in FIG. 16, the rotating directions of the pivots of the respective tools K1, K2 and K3 are made contrary to the rotating directions of the pivot of the adjacent tools.

Figure 17:
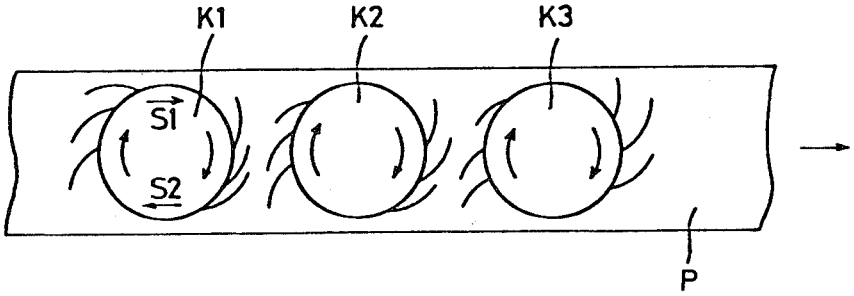
FIG. 17 is a plan view for comparison with FIG. 16.

Now as shown in FIG. 17, if the pivots of the respective tools K1, K2 and K3 disposed side by side rotate in the same direction, the electrolyte gushed out from under the respective electrodes will run into the electrolyte gushed out from under the adjacent electrodes, rendering less efficient discharge and intermixture of the respective electrolytes.

At the point S1 of FIG. 17, the abrasive force is added to the tractive force, whereas at the point S2 the abrasive force is subtracted from the tractive force, and the same phenomena arise as to the respective tools. Therefore, there arises disuniformity of forces on both sides of the band-shape material P and the band-shape material P is biassed sideward or upward as in FIG. 17, giving rise to warps or distortions thereby.

However as shown in FIG. 16, by making the rotating directions of the adjacent tools contrary to each other, the gushing directions of the electrolytes from both of the adjacent tools become the same, and the respective electrolytes are discharged immediately without being intermixed. Even if there is a disuniformity of force between the point S1 and the point S2 of FIG. 17, this disuniformity of force may be cancelled by the adjacent tools and biases, warps and distortions of the band-shape material P are prevented.

INDUSTRIAL UTILITY

As discussed hereinbefore, by means for the equipment of continuously processing a band-shape material of the present invention, in the case the band-shape material being conveyed is continuously polished for many hours, worn-out abrasive matters may be exchanged without interrupting the conveyance of the band-shape material, thereby improving the working efficiency.

Further, by disposing side by side a plurality of tools in such a way that each tool may move freely in vertical direction, the equipment becomes compact and each polishing head may be optionally selected for use.

What we claim:

1. An apparatus for continuously processing a band-shape material comprising;

transverse sliding shafts disposed on a base table, a basal board which freely slides transversely along said transverse sliding shafts, transverse-feeding means by which said basal board is quickly and/or slowly moved transversely, vertical sliding shafts disposed on said basal board, a tool of abrasion in combination with electrolytic polishing which freely slides vertically along said vertical sliding shafts, vertical-feeding means by which said tool is moved vertically against said basal board, and a polishing head which is disposed on said tool and composed of electrodes for electrolysis and abrasive matters for abrasion and by which continuously sent band-shape material is polished.

2. An apparatus for continuously processing a band-shape material as set forth in claim 1 wherein a holding board which freely slides vertically along vertical sliding shafts, a vertical cylinder which moves said holding board vertically against said basal board, a plurality of tools of individual vertical sliding shafts disposed on said holding board, a plurality of tools of abrasion in combination with electrolytic polishing which freely slide vertically along said respective individual sliding shafts, and individual cylinders which move said respective tools vertically and individually against said holding board, are disposed therewith.

3. An apparatus for continuously processing a band-shape material as set forth in claim 2 wherein a spring which presses said tool downward is disposed between said holding board and said tool, upper end of said tool is connected with the piston rod of a liquid pressure cylinder, and a flow regulating valve is disposed in the liquid pressure circuit of the first chamber and the second chamber of said liquid pressure cylinder.

4. An apparatus for continuously processing a band-shape material as set forth in claim 1 wherein a polishing table is disposed in a receptacle tank, two pressing rollers are disposed on both sides of said polishing table in such a way that said band-shape material is slidingly contacted with said polishing table, and in addition, two upward-pressing rollers are disposed on the outer sides of said both pressing rollers so that said band-shape material is positioned at higher level than the upper surface of said polishing table and the level of said band-shape material on said polishing table is made lower than the level at which said band-shape material is conveyed elsewhere.

5. An apparatus for continuously processing a band-shape material as set forth in claim 1 wherein jet nozzles of compressed air are disposed over said band-shape material on both sides of the electrode of the tool, and the air jet from said both nozzles are directed towards said tool.

6. An apparatus for continuously processing a band-shape material as set forth in claim 1 wherein a jet nozzle for fluid such as electrolyte or gas is disposed between two tools and the effluent electrolyte from said both tools is intercepted by the jet fluid from said nozzle.

7. An apparatus for continuously processing a band-shape material as set forth in claim 6 wherein the jet fluid from the nozzle is fan-shaped.

8. An apparatus for continuously processing a band-shape material as set forth in claim 6 wherein a partition wall is formed by the jet fluid from the nozzle.

9. An apparatus for continuously processing a band-shape material as set forth in claim 6 wherein the jet fluid from the nozzle is diverged into two parts, and each part of the jet fluid is directed toward the tools of the respective sides.

10. An apparatus for continuously processing a band-shape material as set forth in claim 2 wherein the rotating directions of adjacent ones of said plurality of tools are contrary to each other.

* * * * *